United States Patent [19]

Rhines

[11] Patent Number: 5,025,515

[45] Date of Patent: Jun. 25, 1991

[54] PORTABLE BATH TUB APPARATUS

[76] Inventor: Michael Rhines, P.O. Box 1464, Orange, Tex. 77630

[21] Appl. No.: 207,108

[22] Filed: Jun. 14, 1988

[51] Int. Cl.[5] ..... A47K 3/06; A47K 3/02

[52] U.S. Cl. ..... 4/585; 4/584

[58] Field of Search ..... 4/585, 584, 506, 509, 4/588, 547, 602, 616, 625, 516, 517; 128/369, 370; 5/61

[56] References Cited

U.S. PATENT DOCUMENTS

| | | | |
|---|---|---|---|
| 1,957,365 | 5/1934 | Steuart | 4/602 |
| 2,471,302 | 5/1949 | Boward | 4/588 |
| 2,840,828 | 7/1958 | Furnberg | 4/509 |
| 3,013,280 | 12/1961 | Coffman et al. | 4/516 |
| 3,805,305 | 4/1974 | Lunblad | 4/616 |
| 4,068,326 | 1/1978 | Deschler | 4/568 |
| 4,081,867 | 4/1978 | Simeola | 4/516 |
| 4,442,838 | 4/1984 | Samson et al. | 4/585 |
| 4,660,233 | 4/1987 | Beaver | 4/517 |
| 4,718,133 | 1/1988 | DiMatteo et al. | 5/61 |

*Primary Examiner*—Henry J. Recla
*Assistant Examiner*—David J. Walczak

[57] ABSTRACT

A portable bath tub apparatus 10 is provided for facilitating the bathing of bedridden persons. The portable bath tub apparatus 10 includes an inflatable bath tub 16. An air pump 60 and tank 61 are provided to inflate the bath tub 16. A movable water storage tank 40 is coupled to the bath tub 16 by a water pump 46 which facilitates the movement of water from the tank to the bath tub 16. A heat dispenser 56 is provided to heat the water in the tank 40 so that the water in the bath tub 16 can be maintained at a desired temperature.

4 Claims, 3 Drawing Sheets

PORTABLE BATH TUB APPARATUS

TECHNICAL FIELD

This invention relates to a bath tub and more particularly to a portable bath tub and associated apparatus to be used by individuals who are confined to their beds. Confinement to ones bed in some situations is an absolute. This becomes a necessary part of treatment in a number of instances such as among the elderly and other individuals whose disabilities limit their movement significantly. In situations requiring bed confinement necessites such as bathing can become a major concern because the confined individuals cannot be readily moved from the bed. Accordingly it is desirable to make the necessity of bathing as convenient as possible without attempting to remove the individual from the bed.

BACKGROUND ART

Attemps have been made to provide devices that address the problem of bathing bedridden patients. For some time inflatable tubs have been provided such as is disclosed in U.S. Pat. No. 4,068,326. However, in addition to the inflatable tub, other portable apparatus, that allows the tub to be conveniently used without the need to identify water supplies, air supplies and other accessories needed to use the tub is desirable. Another device which attempts to portablize the inflatable tub and its associated apparatus is disclosed in U.S. Pat. No. 2,471,302. Although this arrangement has realized some success a totally self contained device is desirable.

DISCLOSURE OF THE INVENTION

The invention relates to a portable bath tub apparatus for facilitating the bathing of bedridden persons. The portable bath tub apparatus in accordance with this invention includes an inflatable tub, having a plurality of drain openings formed therein. An air supply means is provided for inflating the tub. The invention also includes a movable means for storing water adjacent the bath tub and a means for heating the water in the storing means to a predetermined temperature. A means coupled between the bath tub and the water storing means pumps water from the water storing means into the bath tub. Additionally a means coupled to the drain opening in the bath tub is provided for draining the water therefrom once the bath is completed.

BRIEF DESCRIPTION OF THE DRAWING

The details of the invention will be described in connection with the accompanying drawing in which.

BEST MODE FOR CARRYING OUT THE INVENTION

Figure 1:
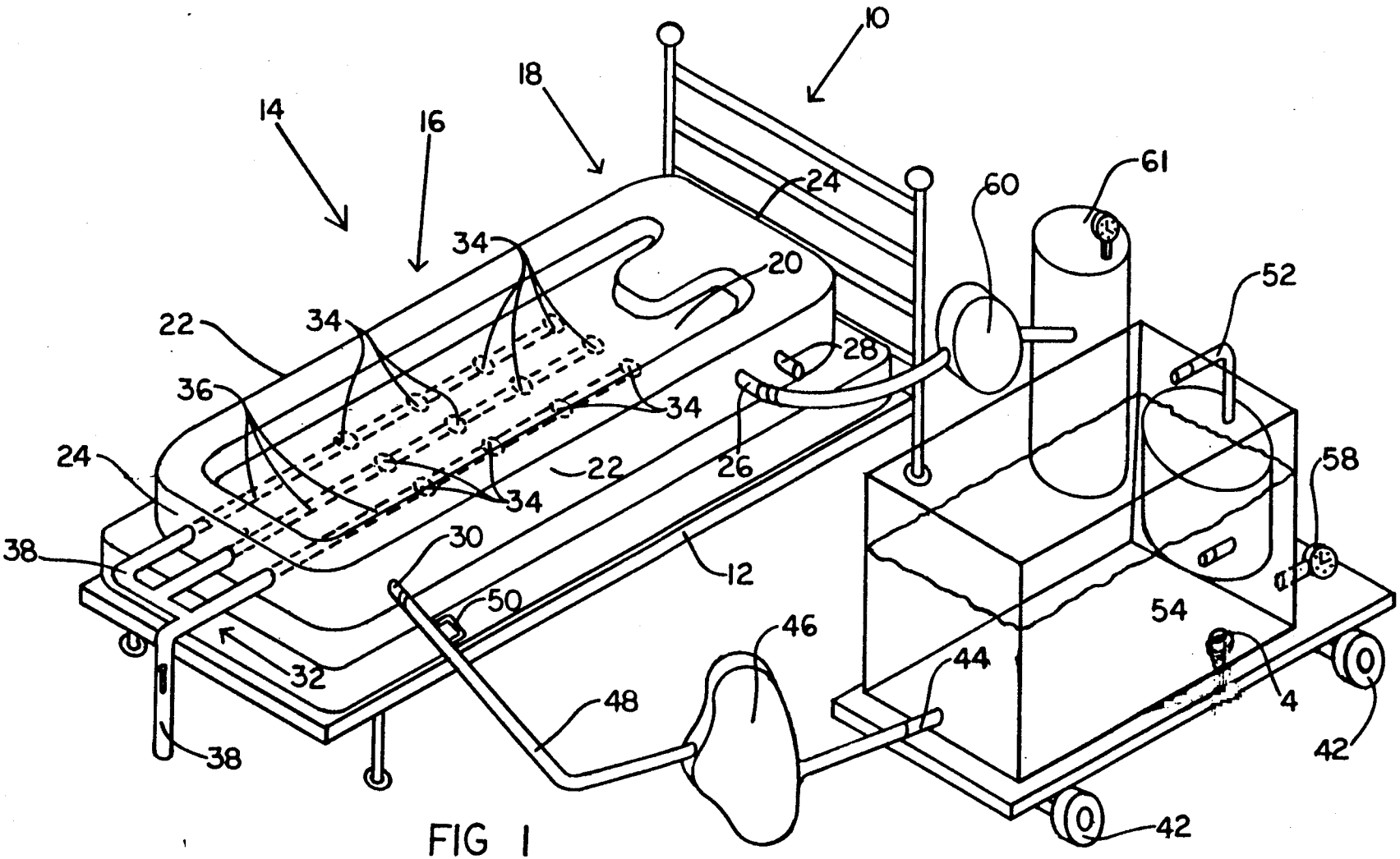
FIG. 1 is a perspective view illustrating the portable bath tub apparatus in accordance with the principles of this invention.
Figure 2:
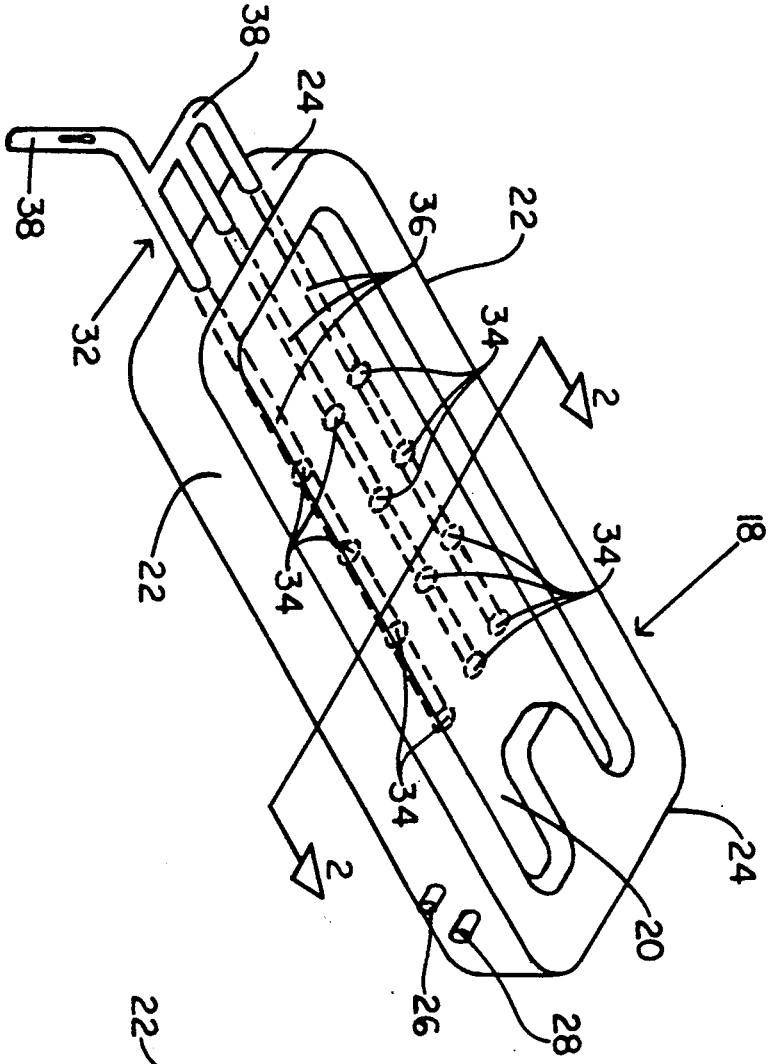
FIG. 2 is a perspective view of the portable bath tub in accordance with the principles of this invention.
Figure 3:
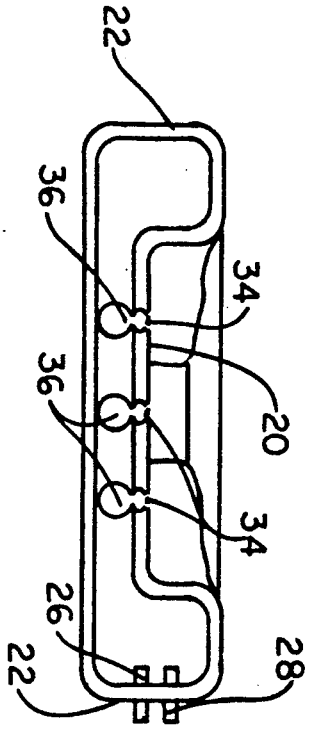
FIG. 3 is a cross-sectional view of the portable bath tub taken along lines 2—2 in accordance with the principles of this invention.

Referring to FIG. 1, there is shown, a bed generally designated by the numeral 10, including a raised frame generally designated by the numeral 12. A portable bath tub apparatus, generally designated by the numeral 14, is provided to facilitate bathing an individual (not shown) who may be confined to the bed 10. The portable bath tub apparatus 14 is provided with an inflatable bath tub generally designated by the numeral 16 (FIG. 2). When inflated the bath tub 16 is formed into a rectangular enclosure, generally designated by the numeral, 18 having a supporting floor 20, side walls 22 and end walls 24. One side wall 22 of the bath tub 16 is provided with an air inlet nozzle 26 for facilitating the inflation of the bath tub and an air exit nozzle 28 for releasing air therefrom.

A water inlet nozzle 30 is provided to allow water into the bath tub 16. A drainage system, generally designated by the numeral 32 is provided for draining water from the bath tub 16. The drainage system 32 is provided with a plurality of spaced aligned apertures 34 formed in the floor 20 of the bath tub 16. Selected apertures 34 communicate through selected drains 36 to allow water to drain from the bath tub. The drains 36 are coupled to a drain connecting valve 38 which facilitates the release of draining water from the bath tub 16.

The portable bath tub apparatus 14 is also provided with a water tank, generally designated by the numeral, 40. The water tank 40 is mounted on wheels 42 to facilitate easy movement of the tank. The tank 40 includes a water outlet nozzle and a drain 45. The water outlet nozzle 44 is coupled to a water pump 46. The water pump 46 selectively pumps water from the tank through a hose 48 and the water inlet nozzle 30 into the bath tub 16. The hose 48 coupled to the pump is provided with a handle 50 so that it can be hand held by a user if the user does not desire to couple the hose to the nozzle 30. The water tank 40 Is also provided with a hot water inlet nozzle 52 and a hot water outlet nozzle 54. The hot water inlet and outlet nozzles 52 and 54 are coupled to a hot water dispenser 56. The hot water dispenser 56 is provided to heat water circulated therethrough from the tank 40 and thereby heat the water in the tank to a desired temperature. A temperature gauge 58 is coupled in tank 40 to allow monitoring of the temperature of the water in the tank.

The portable bath tub apparatus 14 is also provided with an air pump 60. An air tank 61 is provided for holding and dispensing air generated by the air pump. The air tank 61 is coupled to the air inlet nozzle 26 of the bath tub 16 so that the tub can be inflated. The air pump 60 and air tank 61 for convenience may be mounted to the water tank 40.

The water pump 46, the hot water dispenser 56 and the air pump 60 may all be activated for example by a standard voltage and current supply which is generated from a standard wall outlet (not shown).

Figure 4:
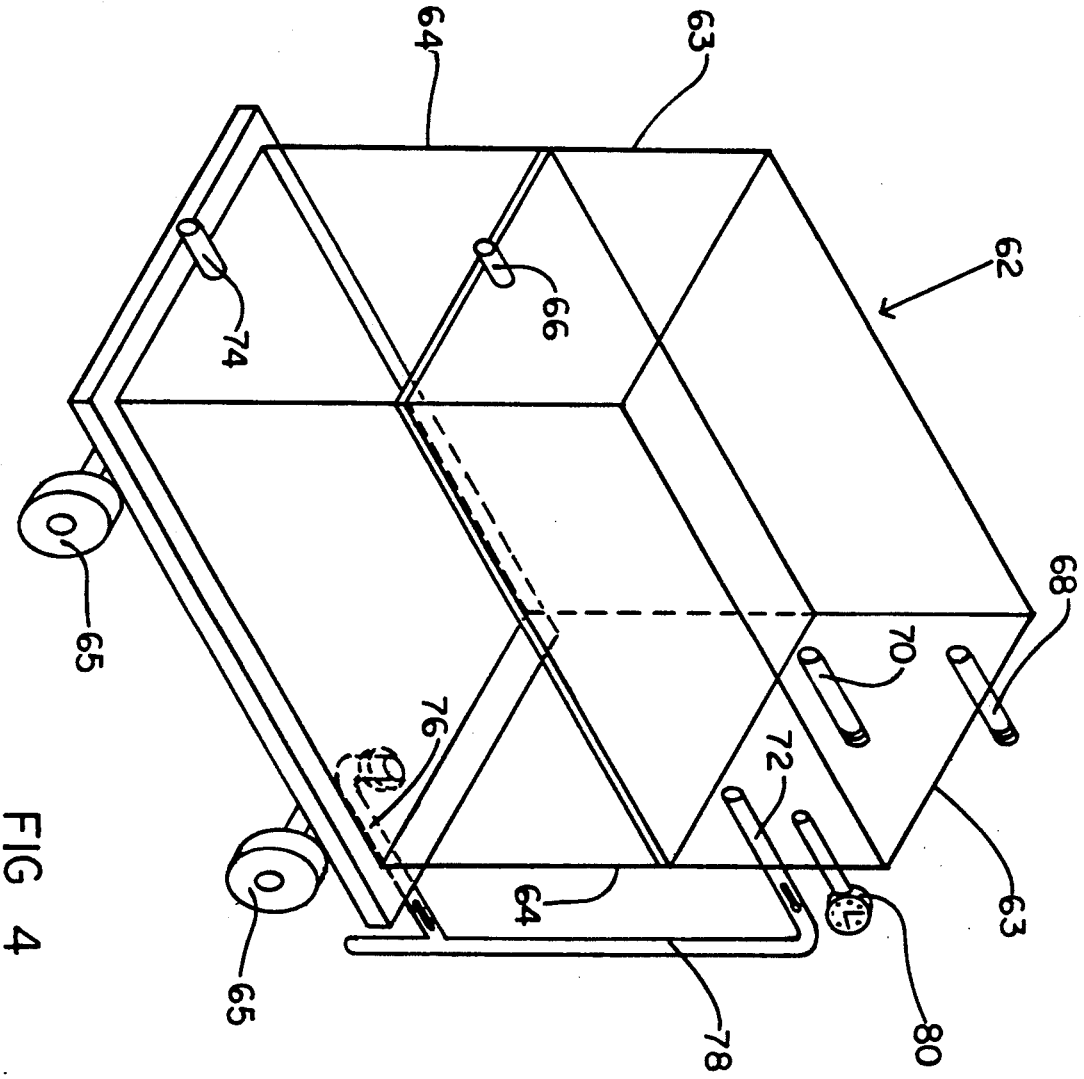
FIG. 4 is a perspective view illustrating a second embodiment of the portable bath tub apparatus in accordance with the principles of the invention.

A second embodiment of a water tank in accordance with the principles of the invention, generally designated by the numeral, 62 is illustrated in FIG. 4. The water tank 62 is provided with a pair of independent tank compartments 63 and 64 and is mounted for movement on wheels 65. The tank compartment 63 is provided to retain water that will be pumped into the tub 16. The tank compartment 63 is provided with an outlet 66 to allow water to be pumped into the tub by the water pump 46.

The tank compartment 63 also includes hot water inlet and outlet nozzles 68 and 70, respectively, to permit the water in the tank 63 to be circulated through the hot water dispenser 56 to be heated. A drain 72 is provided for draining the tub compartment 63 when desired.

The tank compartment 64 is provided to receive water drained from the bath tub 16. The tank 64 is provided with a bath tub drain 74 which is coupled to the drain valve 38 to allow the water in the bath tub to be drained into the tank compartment. The tank compartment 64 also includes a drain 76. The drain 76 of the tank compartment 64 and the drain 72 of the tank compartment 63 are each drained through a drain pipe 78. The tank 62 is also provided with a temperature gauge 80 to allow monitoring of the temperature of the water in the tank.

As illustrated in FIG. 1 when the portable bath tub apparatus is in use the uninflated bath 16 is placed under the person in the bed (not shown) and then inflated by the air pump and tank 60 and 61. As a result the bedridden person can be comfortably situated in the bath tub 16. Water in the tank 60 which is heated to the desired temperature by the heat dispenser 56 is then pumped by the water pump 46 from the tank into the bath tub 16. Once the bath tub 16 is filled to a desired level the pump 46 is turned off and the bedridden person in the bath tub can be bathed.

When the bath is completed the drain valve 38 is opened and the water in the bath tub 16 is drained therefrom through the apertures 34 and associated drains 36. Water can then be directed to drain through a disposing facility, such as a sink or if the tank 62 is used water can be directed back to the water disposal tank compartment 64. Once all the water is eliminated and drained from the bath tub 16 the bath tub can be deflated through the air exit nozzle 28 and then stored.

This invention has been shown and described in what is considered to be the most practical and preferred embodiment. However, it should be recognized that changes may be made by those skilled in the art without departing from the spirit and scope of the invention.

What is claimed is:

1. A portable bath tub apparatus including:

an inflatable bath tub having a plurality of drain openings formed therein, an air inlet nozzle for inflating the bath tub, and an air outlet nozzle for allowing the release of air from the bath tub;

an air pump for generating air to inflate the bath tub;

an air tank coupled between the air pump and the bath tub air inlet nozzle for storing and dispensing air from the air pump so that the bath tub can be inflated;

movable means for storing water therein adjacent the bath tub;

means for heating the water in the storing means to a predetermined temperature;

a hot water inlet nozzle coupled to the water heating means to allow water to flow from the water storing means into the water heating means;

a hot water outlet nozzle coupled to the water heating means to allow water to flow from the water heating means to the water storing means;

means coupled between the bath tub and the water storing means for pumping water from the water storing means into the bath tub to fill the bath tub to a desired level;

a water outlet nozzle coupled to the water storing means and couplable between the water storage means and the water pumping means; and means coupled to the drain openings in the bath tub for selectively draining water from the bath tub.

2. A portable bath tub apparatus as defined in claim 1 further including a means for monitoring the temperature of the water in the water storing means.

3. A portable bath tub apparatus as defined in claim 2 further including a means coupled to the water storing means for containing water disposed of from the bath tub.

4. A portable bath tub apparatus as defined in claim 3 wherein the water storing means includes a plurality of wheels coupled thereunder to allow movement of the water storing means.

* * * * *